US007005170B1

(12) United States Patent
Simpson et al.

(10) Patent No.: US 7,005,170 B1
(45) Date of Patent: Feb. 28, 2006

(54) ASSEMBLY FOR PROVIDING INFORMATION ABOUT AN INDIVIDUAL

(76) Inventors: Marne L. Simpson, 705 W. Oak St., Lodi, CA (US) 95240; Stephen M. Simpson, 705 W. Oak St., Lodi, CA (US) 95240

( * ) Notice: Subject to any disclaimer, the term of this patent is extended or adjusted under 35 U.S.C. 154(b) by 97 days.

(21) Appl. No.: 10/695,672

(22) Filed: Oct. 29, 2003

(51) Int. Cl.
*B32B 9/00* (2006.01)

(52) U.S. Cl. ..... 428/40.1; 40/124.06; 229/68.1; 229/71; 283/74; 283/81; 283/101; 428/41.7; 428/41.8; 428/42.1; 428/42.2; 428/192; 428/202; 428/354

(58) Field of Classification Search ..... 428/40.1, 428/41.8, 42.1, 42.2, 202, 354, 192, 41.7; 283/74, 81, 101; 229/68.1, 71; 40/124.06
See application file for complete search history.

(56) References Cited

U.S. PATENT DOCUMENTS 3,372,724 A * 3/1968 Rouse ..... 206/496
3,525,470 A * 8/1970 Carrigan ..... 229/74
4,389,801 A 6/1983 Sharrock et al.
4,930,234 A 6/1990 Schmidt
5,127,676 A * 7/1992 Bockairo ..... 283/81
5,269,564 A 12/1993 Arnt
5,283,093 A 2/1994 All
5,377,836 A 1/1995 Eisenbraun
5,700,037 A 12/1997 Keller
5,765,875 A 6/1998 Rowley
6,170,665 B1 1/2001 Pehr
6,244,431 B1 6/2001 VanFleet
6,315,206 B1 11/2001 Hansen et al.
2002/0100797 A1 8/2002 Hollingsworth et al.
2003/0066777 A1 4/2003 Malone

* cited by examiner

*Primary Examiner*—Nasser Ahmad
(74) *Attorney, Agent, or Firm*—Thomas R. Lampe

(57) ABSTRACT

An assembly for providing information about an individual such as a lost child includes an envelope and an information sheet releasably adhesively connected to the rear panel of the envelope. The information sheet is manually removable from the rear envelope panel for insertion into the envelope. Removal of the information sheet exposes the adhesive on the envelope rear panel and the adhesive is used to apply the envelope to an individual's clothing.

6 Claims, 2 Drawing Sheets

ASSEMBLY FOR PROVIDING INFORMATION ABOUT AN INDIVIDUAL

TECHNICAL FIELD

This invention relates to an assembly employed to provide information about an individual, components of the assembly being worn on the individual's clothing. The invention is applicable, for example, to provide information relating to a lost child.

BACKGROUND OF THE INVENTION

The arrangement disclosed and claimed herein has particular, although not exclusive, application to providing information relating to a lost child. As will be seen below, the invention includes an assembly incorporating components which are attached temporarily to the individual's clothing which provides information concerning a child or other individual.

The assembly is sold as a unit and components thereof may be quickly utilized to provide a secure repository of information pertaining to a child or other wearer. The invention has application in certain instances for use by adults; for example, the components of the assembly may be worn by a victim of Alzheimer's disease and used by others to identify such an individual as well as provide other pertinent information.

A search conducted relative to this invention located the following United States patent documents: U.S. Pat. No. 6,170,665, issued Jan. 9, 2001, U.S. Pat. No. 6,315,206, issued Nov. 13, 2001, U.S. Pat. No. 6,244,431, issued Jun. 12, 2001, U.S. Pat. No. 5,283,093, issued Feb. 1, 1994, U.S. Pat. No. 5,269,564, issued Dec. 14, 1993, U.S. Pat. No. 5,377,836, issued Jan. 3, 1995, U.S. Pat. No. 4,930,234, issued Jun. 5, 1990, U.S. Pat. No. 5,700,037, issued Dec. 23, 1997, U.S. Pat. No. 4,389,801, issued Jun. 28, 1983, U.S. Pat. No. 5,765,875, issued Jun. 16, 1998, U.S. Patent Application Publication No. U.S. 2003/0066777, Published Apr. 10, 2003 and U.S. Patent Application Publication No. U.S. 2002/0100797, Published Aug. 1, 2002.

The above-identified patent publications do not teach or suggest the combination of structural components incorporated in the assembly disclosed and claimed herein.

DISCLOSURE OF INVENTION

The present invention relates to an assembly which is in unitary form and which can be reconfigured to provide an arrangement which can be worn by an individual to provide information concerning the individual. As indicated above, the invention has particular application to providing information about a lost child, however other applications are possible also.

The invention is an assembly of unitary construction for providing information about an individual. The assembly incorporates an envelope including a front envelope panel and a rear envelope panel attached to the front envelope panel. The front envelope panel and the rear envelope panel define an envelope interior and an envelope opening communicating with the envelope interior. The rear envelope panel has a back surface with adhesive thereon.

The assembly also includes a double-sided information sheet releasably adhesively connected at one side thereof to the rear envelope panel by the adhesive on the back surface of the rear envelope panel. The other side of the information sheet has a surface for providing textual information relating to the individual.

The information sheet is manually removable from the adhesive on the back surface of the rear envelope panel and insertable into the envelope interior. The adhesive on the back surface of the rear envelope panel is exposed upon removal of the information sheet from the rear envelope panel, enabling the adhesive on the back surface of the rear envelope panel to adhesively secure the envelope to the individual's clothing.

Other features, advantages and objects of the present invention will become apparent with reference to the following description and accompanying drawings.

BEST MODE FOR CARRYING OUT THE INVENTION

Figure 1:
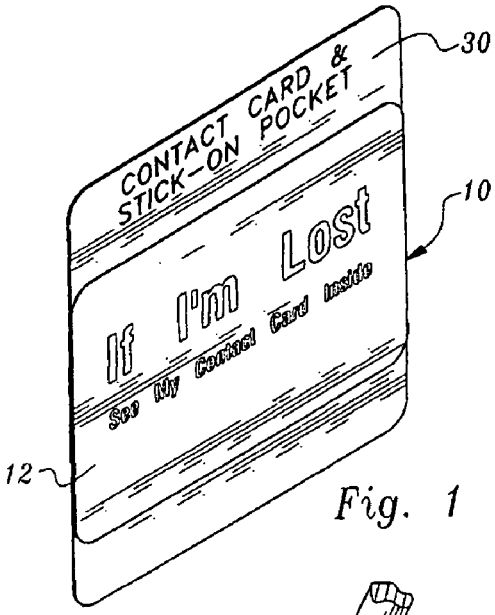
FIG. 1 is a front, perspective view of a unitary assembly constructed in accordance with the teachings of the present invention prior to use.
Figure 2:
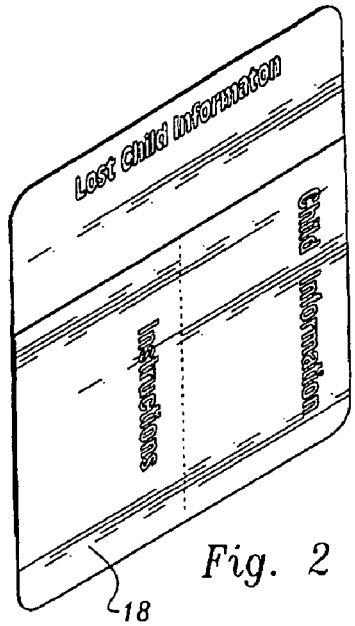
FIG. 2 is a rear, perspective view of the unitary assembly shown in FIG. 1.
Figure 3:
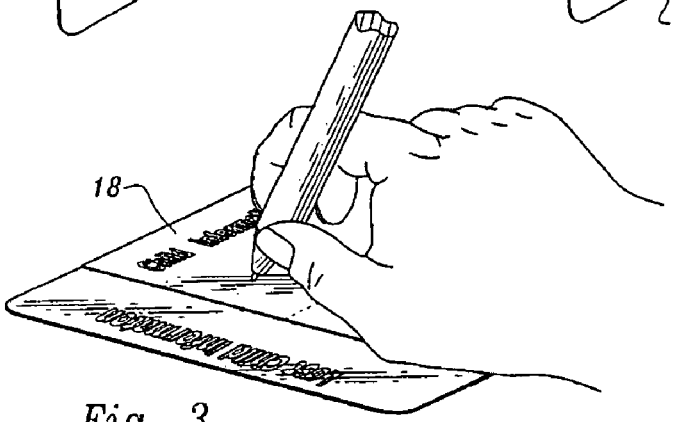
FIG. 3 is a perspective view of the unitary assembly, a person writing information about an individual on an information sheet located at the back of the unitary assembly.

Referring now to the drawings, a unitary assembly constructed in accordance with the teachings of the present invention is shown in its entirety and in the condition it is in prior to use in FIGS. 1–3.

Figure 4:
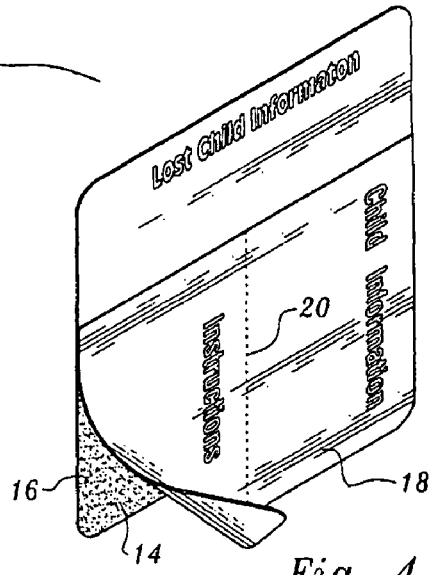
FIG. 4 is a view similar to FIG. 2, but illustrating the information sheet being removed from adhesive releasably securing the information sheet to the other components of the unitary assembly.

The assembly includes an envelope 10 having a front envelope panel 12 and a rear envelope panel 14, the latter being covered by an adhesive 16 as shown in FIG. 4 on the back surface thereof. The rear envelope panel of the assembly is completely covered by a double-sided information sheet or card 18 having a fold line 20. The information sheet has an outer surface for providing textual information relating to a child or other individual who will be wearing components of the assembly during use.

FIG. 3 shows an individual writing the information on the information sheet. Information may for example include telephone numbers, medical or special needs, etc. In the event that the wearer is a child it may be advisable not to put the child's name or address on the card. The information sheet or card may have preprinted instructions regarding its use. That is, the textual information provided may be both printed and written.

Figure 5:
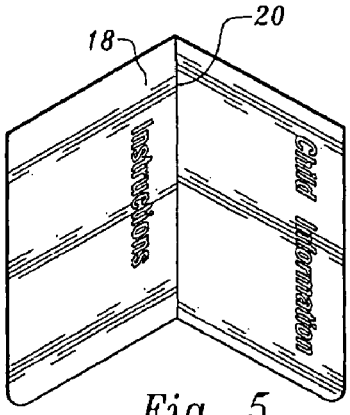
FIG. 5 is a perspective view showing the information sheet removed and in partially folded condition.

After the information sheet or card is filled out as desired, it is manually removed from the adhesive 16 on the back surface of the rear envelope panel as shown in FIG. 4. FIG. 5 shows the sheet removed and partially folded about fold line 20.

Figure 6:
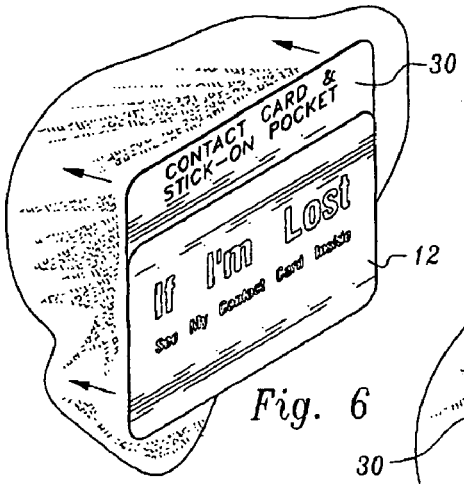
FIG. 6 illustrates the assembly without the information sheet in the process of being adhesively secured to an individual's clothing.

The adhesive 16 on the back surface of the rear envelope panel is exposed upon removal of the information sheet. This enables the adhesive on the back surface of the rear envelope panel to be utilized to adhesively secure the envelope to the child or other wearer's clothing. FIG. 6 shows the assembly without the information sheet or card 18 in the process of being placed into engagement with the clothing to bring the adhesive 16 in contact therewith.

Figure 7:
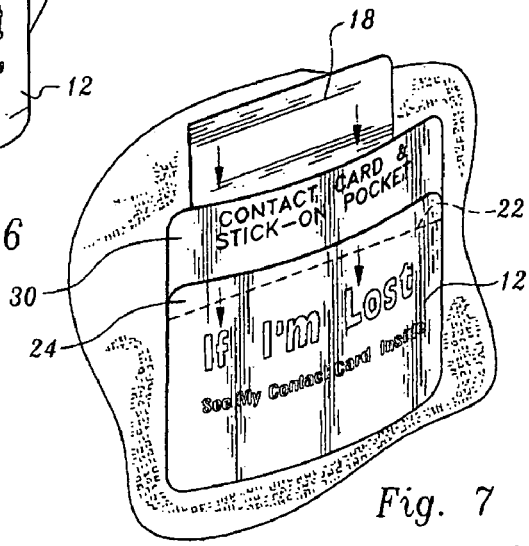
FIG. 7 is a perspective view showing the information sheet being positioned in an envelope of the assembly after the envelope has been adhesively secured to the individual's clothing.

The opening to the envelope interior is located at the top end of the rear envelope panel 14 as shown by the dash line 22 in FIG. 7. The height of the front envelope panel 12 is somewhat greater than the height of rear envelope panel 14 whereby the front envelope panel includes a front envelope panel portion 24 extending above the envelope opening and above the top end of the rear envelope panel.

Figure 8:
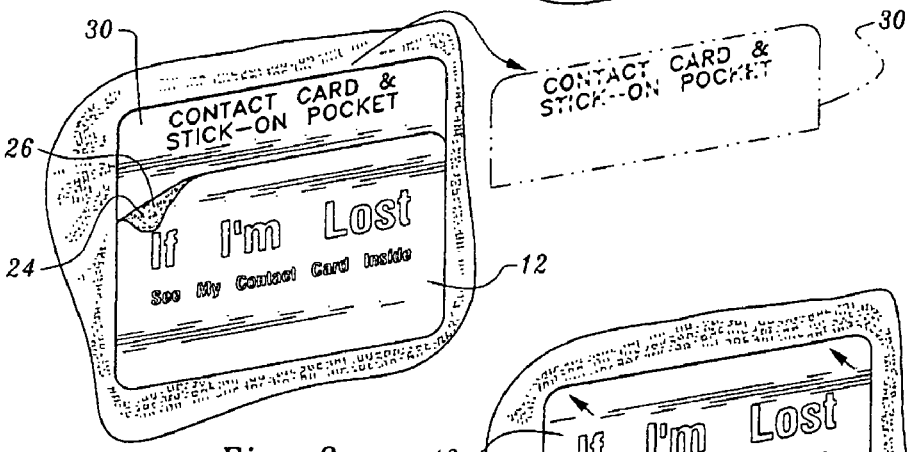
FIG. 8 is a perspective view illustrating a front envelope panel having adhesive on a back side thereof in the process of being pulled away from a supplemental sheet of the assembly, the supplemental sheet also being shown by dash lines after it has been removed from the assembly.
Figure 9:
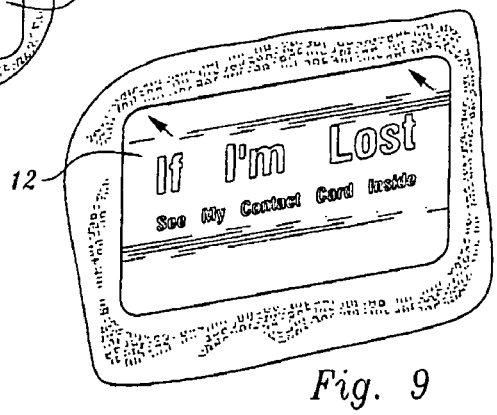
FIG. 9 illustrates the final step of securing the assembly envelope to a wearer's clothing after removal of the supplemental sheet.

As can be seen with reference to FIG. 8, the front envelope panel portion 24 has a back surface covered with adhesive 26. Adhesive 26 adhesively secures a double-sided supplemental sheet 30 to the front envelope panel portion 24. The supplemental sheet 30 is to be retained by the parent, guardian or other person responsible for the child or other wearer and may provide instructions about what to do in the event a child or other wearer becomes lost as well as locations thereon on which reminders, such as descriptions of the child's clothing may be written.

In FIG. 7 the supplemental sheet 30 is still in place. The folded information sheet or card 18 is inserted into the envelope through opening 22, the opening 22 being disposed along an imaginary straight line extending between the opposed side edges of the envelope and between the top end and bottom end thereof.

After the information sheet 18 has been inserted in the envelope and the supplemental sheet 30 removed from the assembly in the manner shown in FIG. 8, the adhesive on the back surface of the front envelope panel portion 24 is exposed and the front envelope panel portion 24 is pressed against the wearer's clothing so that the adhesive 26 secures the top of the envelope in place to close the envelope and prevent the information sheet 18 from being dislodged from the envelope until opening thereof to obtain information on the card 18 is desired.

Preferably, at least the envelope front panel is opaque, being formed for example of opaque plastic sheeting, and has printed matter thereon alerting an observer to the fact that an information sheet is within the envelope.

What is claimed is:

1. An assembly of unitary construction for providing information relating to an individual, said assembly comprising, in combination:

an envelope including a front envelope panel and a rear envelope panel attached to said front envelope panel, said front envelope panel and said rear envelope panel defining an envelope interior and an envelope opening communicating with said envelope interior, said rear envelope panel having a back surface with adhesive thereon; and a double-sided information sheet releasably adhesively connected at one side thereof to said rear envelope panel by the adhesive on the back surface of the rear envelope panel, the other side of said information sheet having a surface for providing textual information relating to the individual, said information sheet being manually removable from the adhesive on the back surface of said rear envelope panel and insertable into the envelope interior, said adhesive on the back surface of said rear envelope panel being exposed upon removal of said information sheet from said rear envelope panel enabling said adhesive on the back surface of said rear envelope panel to adhesively secure said envelope to the individual's clothing, said front envelope panel having a front envelope panel portion projecting upwardly from and beyond said rear envelope panel, said front envelope panel portion having a back surface with adhesive thereon, said assembly additionally comprising a double-sided supplemental sheet releasably connected at one side thereof to said front envelope panel portion by the adhesive on the back surface of said front envelope panel portion, said supplemental sheet being manually removable from the adhesive on the back surface of said front envelope panel portion, the adhesive on the back surface of said front envelope panel portion being exposed upon removal of the supplemental sheet from said front envelope panel portion enabling the adhesive on the back surface of said front envelope panel portion to adhesively secure said front envelope panel portion to the individual's clothing wherein said envelope has opposed side edges, said information sheet and said supplemental sheet extending from side edge to side edge of said envelope, said information sheet having a fold line facilitating folding said information sheet prior to insertion thereof into said envelope interior; and said supplemental sheet projects beyond upwardly beyond said front envelope panel portion.

2. The assembly according to claim 1 wherein said information sheet and said supplemental sheet are separately removable.

3. The assembly according to claim 1 wherein said envelope front panel is opaque and has printed matter thereon alerting an observer to the fact that the information sheet is in the envelope.

4. The assembly according to claim 1 wherein said adhesive on the back surface of said front envelope panel portion substantially covers said front envelope panel portion back surface and wherein the adhesive on the back side of said rear envelope panel substantially covers said rear envelope panel back surface.

5. The assembly according to claim 1 wherein said envelope has a top end, a bottom end and opposed side edges, said envelope opening located between said top end and said bottom end and disposed along an imaginary straight line extending between said opposed side edges.

6. An assembly of unitary construction for providing information relating to an individual, said assembly comprising, in combination:

an envelope including a front envelope panel and a rear envelope panel attached to said front envelope panel, said front envelope panel and said rear envelope panel defining an envelope interior and an envelope opening communicating with said envelope interior, said rear envelope panel having a back surface with adhesive thereon;

a double-sided information sheet releasably adhesively connected at one side thereof to said rear envelope panel by the adhesive on the back surface of the rear envelope panel, the other side of said information sheet having a surface for providing textual information relating to the individual, said information sheet being manually removable from the adhesive on the back surface of said rear envelope on the back surface of said rear envelope panel being exposed upon removal of said information sheet from said rear envelope panel enabling said adhesive on the back surface of said rear envelope panel to adhesively secure said envelope to the individual's clothing, said front envelope panel having a front envelope panel portion extending upwardly beyond the rear panel and disposed above said envelope opening and said information sheet and said rear envelope panel disposed below said envelope opening, and adhesive on a back surface of said front envelope panel portion for securing the front envelope panel portion to the individual's clothing above the location of the envelope opening to retain the information sheet in the envelope interior after insertion of the information sheet therein wherein said envelope has opposed side edges, said information sheet and said supplemental sheet extending from side edge to side edge of said envelope, said information sheet having a fold line facilitating folding said information sheet prior to insertion thereof into said envelope interior; and said supplemental sheet projects beyond upwardly beyond said front envelope panel portion.

* * * * *